US006022267A

United States Patent [19]

Chyn

[11] Patent Number: 6,022,267

[45] Date of Patent: Feb. 8, 2000

[54] GRINDER

[76] Inventor: Mick Chyn, No. 24, Lane 269, Fu-Teh 1 Rd., Shi Zju Town, Taipei Hsien, Taiwan

[21] Appl. No.: 08/872,785

[22] Filed: Jun. 11, 1997

[30] Foreign Application Priority Data

Jun. 15, 1996 [TW] Taiwan ..... 85209073

[51] Int. Cl.[7] ..... B24B 23/00

[52] U.S. Cl. ..... 451/344; 451/356; 451/358

[58] Field of Search ..... 451/344, 342, 451/451, 455, 356, 358, 359, 360; 279/905, 906

[56] References Cited

U.S. PATENT DOCUMENTS

| | | | |
|---|---|---|---|
| 2,411,584 | 11/1946 | Miller et al. | 451/344 |
| 4,062,082 | 12/1977 | Azzopardi | 451/359 |
| 5,471,698 | 12/1995 | Francis et al. | 451/344 |
| 5,564,969 | 10/1996 | Tsang | 451/344 |
| 5,775,981 | 7/1998 | Yang | 451/358 |
| 5,851,141 | 12/1998 | Elmore | 451/344 |

FOREIGN PATENT DOCUMENTS

| | | | |
|---|---|---|---|
| 69981 | 8/1893 | Germany | 451/344 |
| 577198 | 5/1958 | Italy | 451/344 |

*Primary Examiner*—Eileen P. Morgan
*Attorney, Agent, or Firm*—Pro-Techtor International Services

[57] ABSTRACT

A grinder including a power drive unit having a driving shaft and a bevel gear fixedly mounted on one end of the driving shaft, and a grinding unit coupled to the power drive unit, the grinding unit including a grinding bit and a transmission mechanism coupled between the grinding bit and the bevel gear of the power drive unit, wherein the grinding unit has a retaining hole and a coupling flange disposed at a rear side thereof at different elevations; the power drive unit has a front coupling slot at a bottom side thereof which receives the coupling flange of the grinding unit, a pair of lugs raised from the periphery at a top side thereof, a lever pivoted to the lugs, and a hook pivoted to the lever and forced by the lever to hook in the retaining hole of the grinding unit. The transmission mechanism of the grinding unit can be alternatively made in a first form to turn the grinding bit in X-axis, a second form to turn the grinding bit in Y-axis, or a third form to reciprocate the grinding bit.

4 Claims, 6 Drawing Sheets

GRINDER

BACKGROUND OF THE INVENTION

The present invention relates to grinders, and more particularly to such a grinder which comprises a power drive unit, and three interchangeable grinding units, wherein the first grinding unit is adapted for turning a grinding bit in X-axis direction; the second grinding unit is adapted for turning a grinding bit in Y-axis direction; the third grinding unit is adapted for reciprocating a grinding bit.

A variety of grinders have been disclosed for different grinding purposes, and have appeared on the market. Because different grinders are designed for different grinding purposes, one shall have to prepare many grinders for use in different conditions. It is expensive to prepare a set of grinders. Furthermore, it is inconvenient to carry a set of grinders. When not in use, much storage space is needed to store the grinders.

SUMMARY OF THE INVENTION

The present invention has been accomplished to provide a grinder which eliminates the aforesaid drawbacks. It is the main object of the present invention to provide a grinder which is comprised of a power drive unit, and a plurality of interchangeable grinding units alternatively detachably coupled to the power drive unit for different grinding purposes. According to the present invention, the grinder comprises a power drive unit having a driving shaft and a bevel gear fixedly mounted on one end of the driving shaft, and three interchangeable grinding units alternatively coupled to the power drive unit for different grinding purposes, wherein each grinding unit comprises a retaining hole and a coupling flange disposed at the back at different elevations; the power drive unit has a front coupling slot at a bottom side thereof which receives the coupling flange of the selected grinding unit, a pair of lugs raised from the periphery at a top side thereof, a lever pivoted to the lugs, and a hook pivoted to the lever and forced by the lever to hook in the retaining hole of the selected grinding unit. The grinding units include a first one adapted to turn a grinding bit in X-axis, a second one adapted to turn a grinding bit in Y-axis, and a third one adapted to reciprocate a grinding bit.

DETAILED DESCRIPTION OF THE PREFERRED EMBODIMENT

Figure 1:
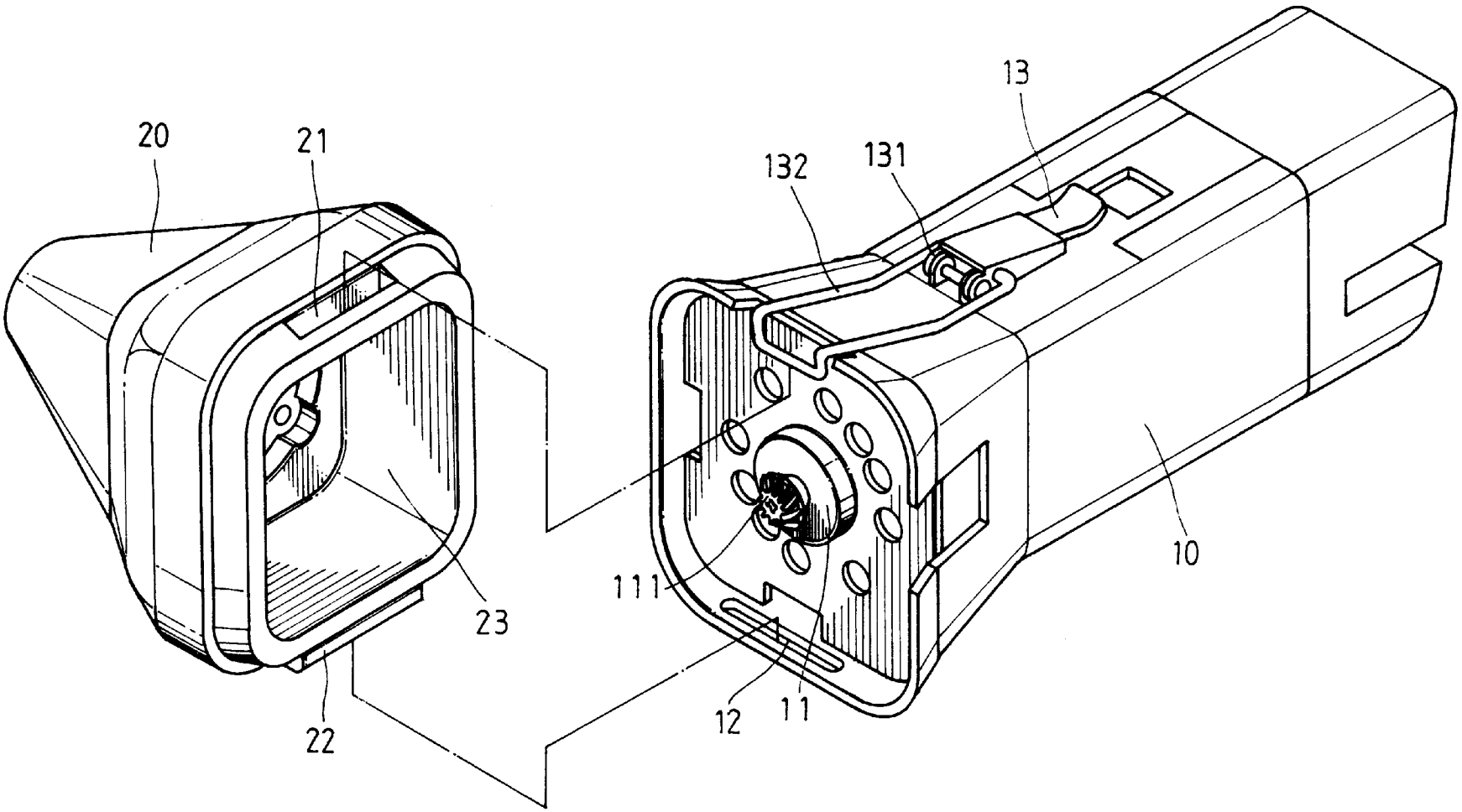
FIG. 1 is an exploded view of a grinder according to the present invention.
Figure 2:
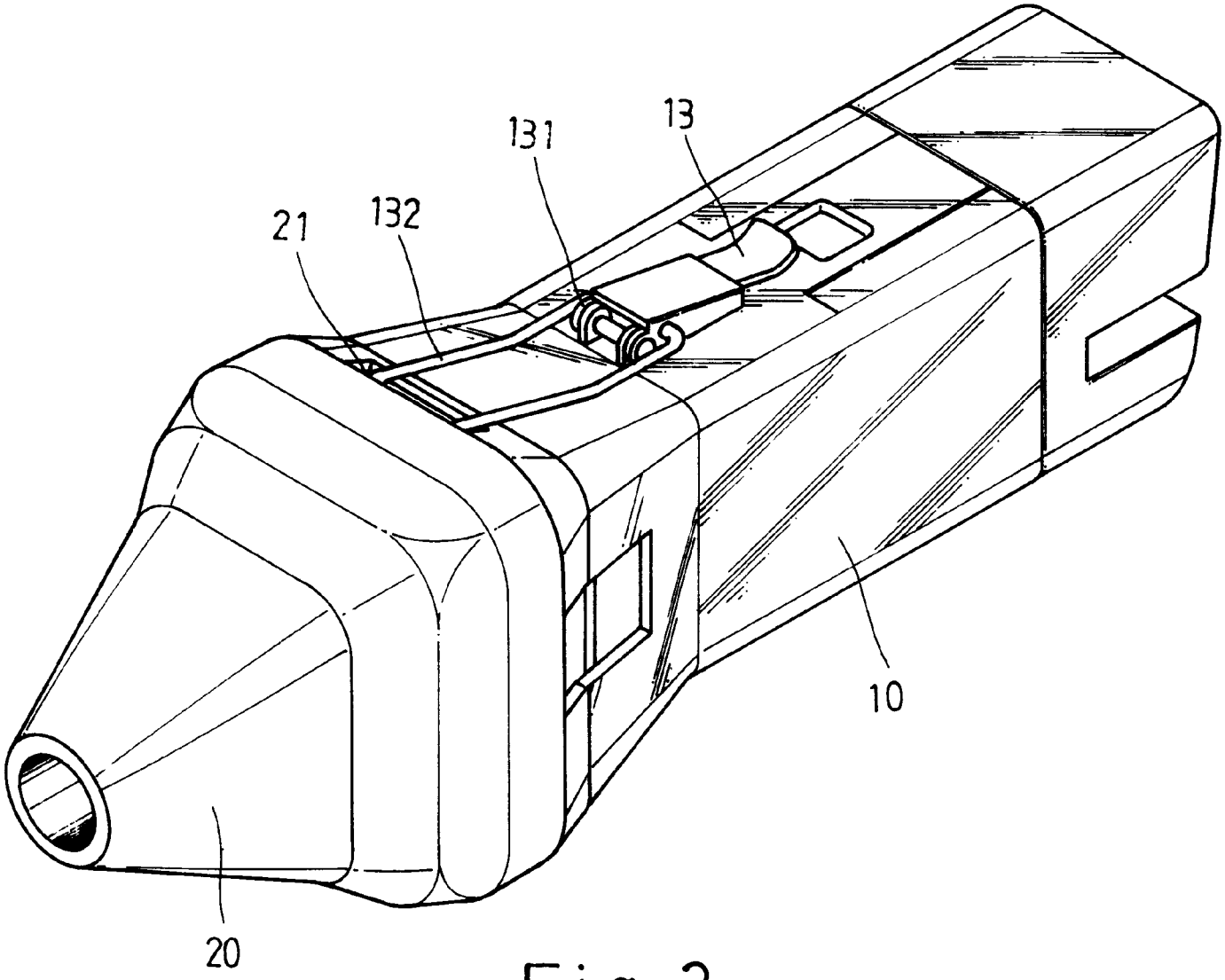
FIG. 2 is an elevational view of the grinder shown in FIG. 1.
Figure 3:
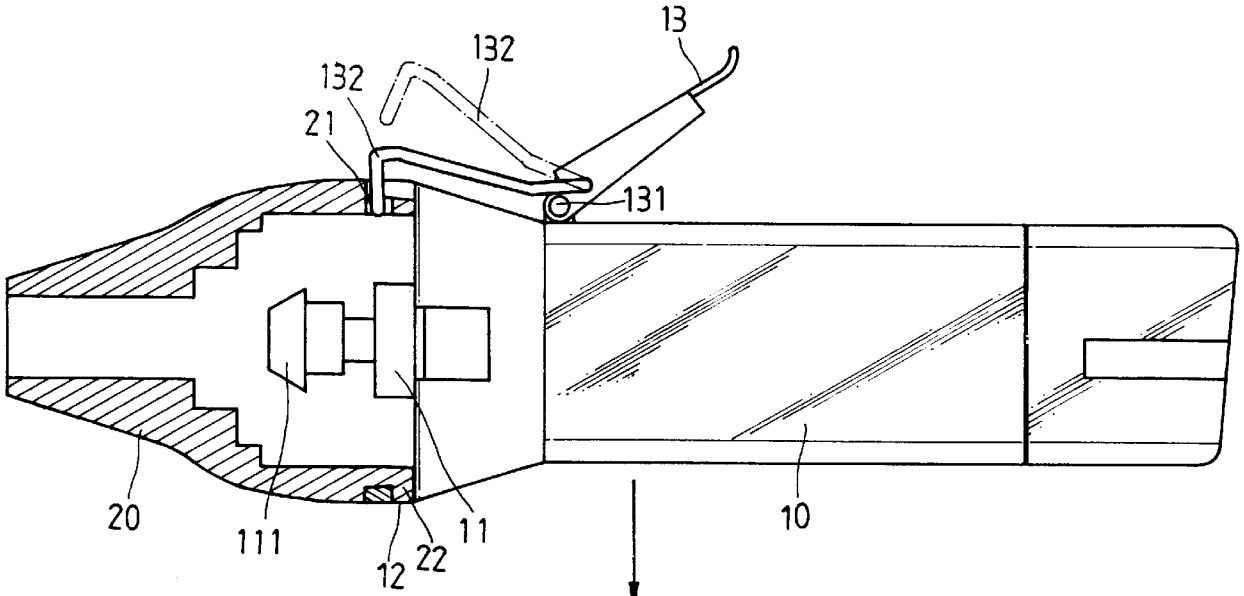
FIG. 3 is a sectional assembly view of the grinder shown in FIG. 1, showing the hook of the power drive unit hooked in the retaining hole of the grinding unit.
Figure 4:
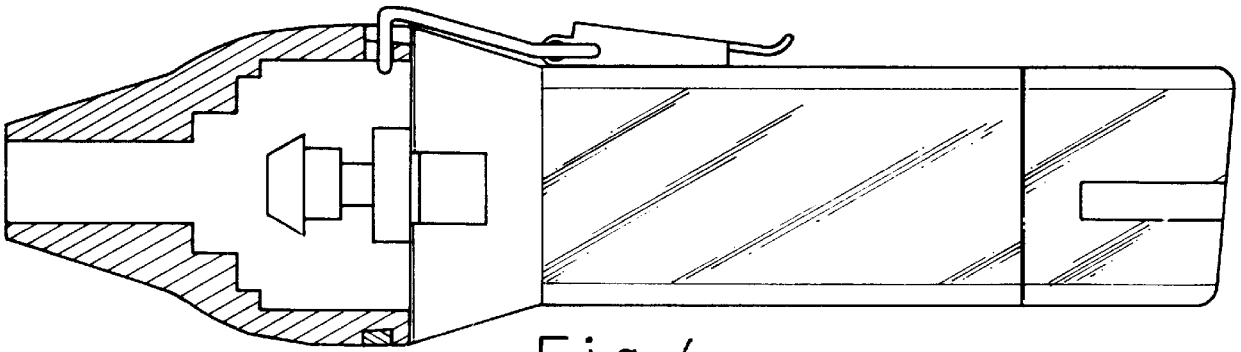
FIG. 4 is similar to FIG. 3 but shown the lever turned down, the hook locked.

Referring to FIG. 1, a grinder set in accordance with the present invention is generally comprised of a power drive unit 10, and grinding unit 20. The power drive unit 10 comprises a driving shaft 11 at the center driven by for example a motor (not shown), a bevel gear 111 fixedly mounted on one end of the driving shaft 11 turned with the driving shaft 11 to drive the grinding unit 20, a front coupling slot 12, a pair of lugs 131 raised from its top side, a lever 13 pivoted to the lugs 131, and a hook 132 pivoted to the lever 13. The grinding unit 20 comprises a rear receiving chamber 23, a retaining hole 21 and a coupling flange 22 disposed at top and bottom sides of the rear receiving chamber 23.

Referring to FIGS. from 2 to 4 and FIG. 1 again, the grinding unit 20 and the power drive unit 10 are fastened together by: inserting the coupling flange 22 of the grinding unit 20 into the coupling slot 12 of the power drive unit 10 from the top, then hooking the hook 132 of the power drive unit 10 in the retaining hole 21 of the grinding unit 20, and then turning down the lever 13. When the lever 13 is turned down and closely attached to the top side of the power drive unit 10, the hook 132 is firmly secured to the retaining hole 21 of the grinding unit 20, and therefore the connection between the power drive unit 10 and the grinding unit are locked.

Figure 9:
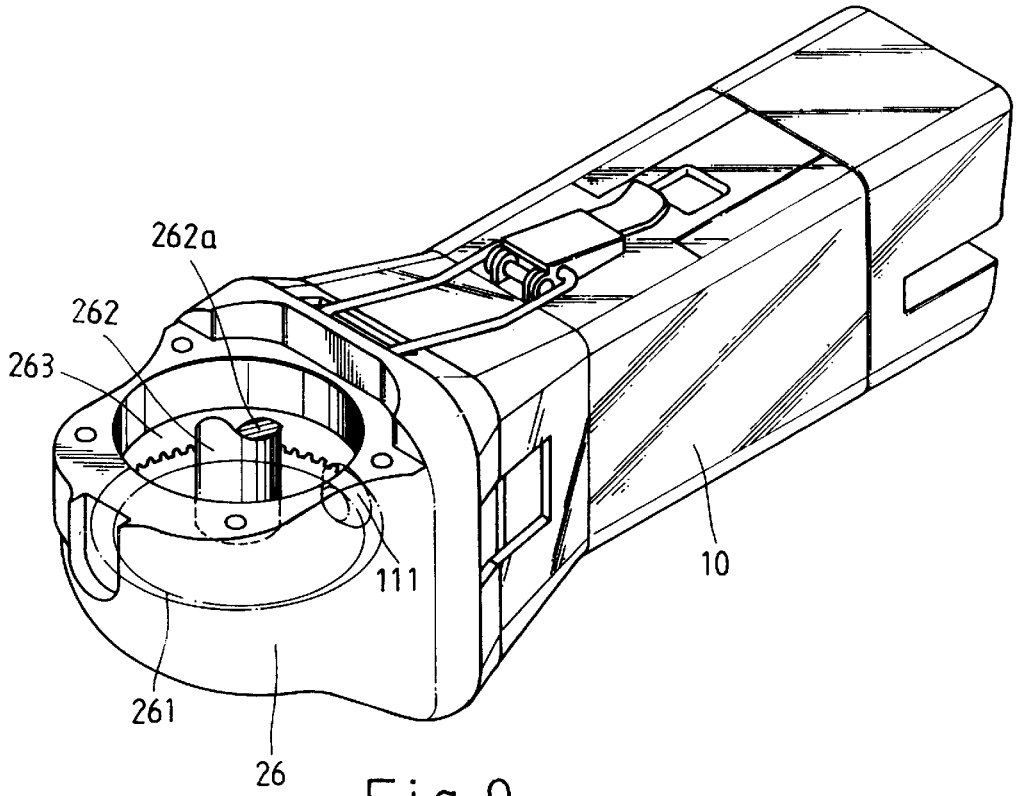
FIG. 9 is a perspective view of the present invention showing a third form of the grinding unit.

Referring to FIGS. from 5 to 9, the grinding unit 20 can be made in the form of a rotary grinding unit 24 (see FIG. 5), reciprocating grinding unit 25 (see FIGS. from 6 to 8) or surface grinding unit 26 (see FIG. 9).

Figure 5:
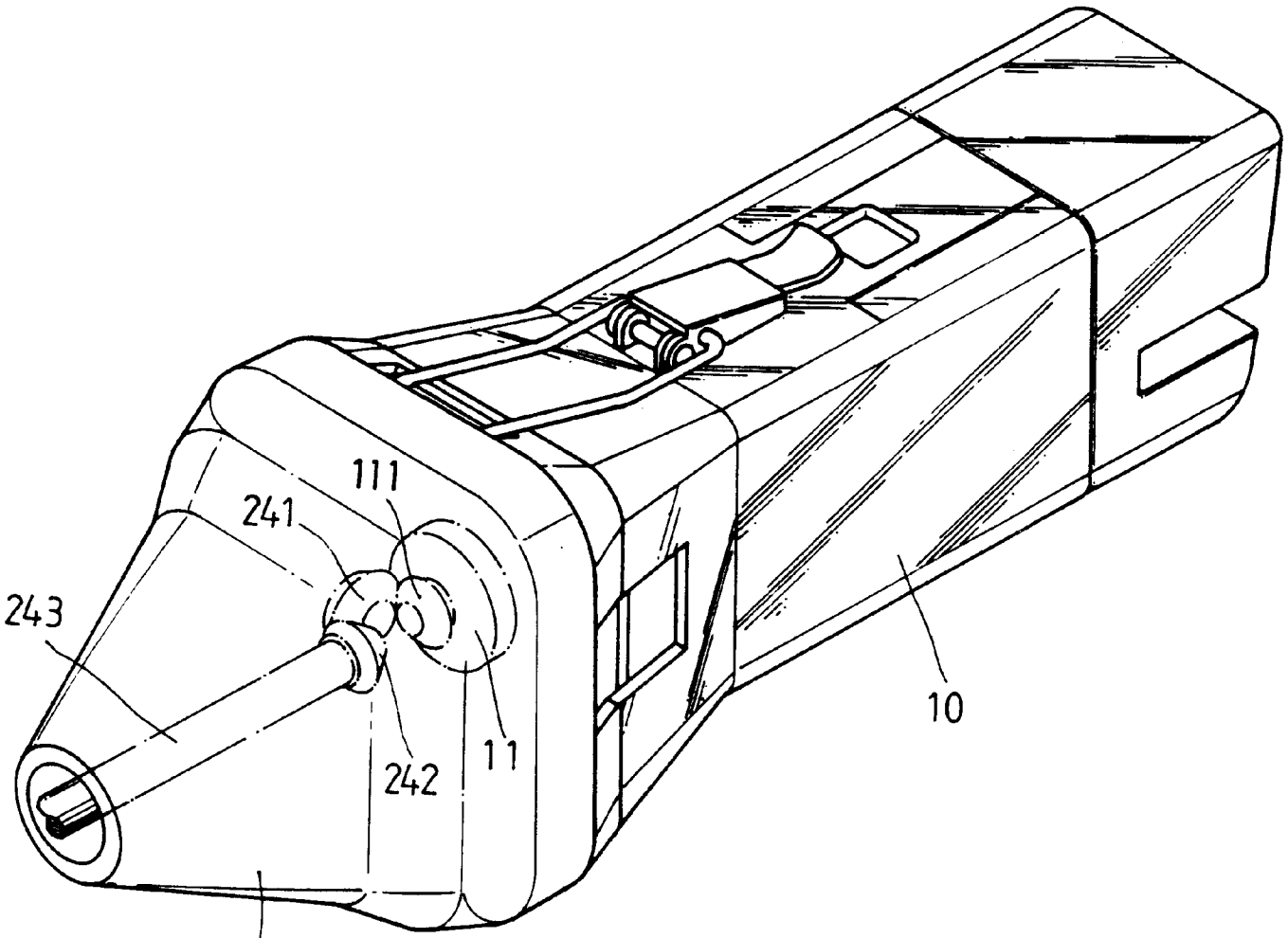
FIG. 5 is a perspective view of the present invention showing a first form of the grinding unit.

Referring to FIG. 5, the rotary grinding unit 24 comprises transmission shaft 243 having a front end mounted with a grinding bit (not shown) and a rear end fixedly mounted with a bevel gear 242, and a transmission gear 241 meshed between the bevel gear 242 of the transmission shaft 243 and the bevel gear 111 of the power drive unit 10. When the driving shaft 11 is turned, the transmission gear 241 is driven by the bevel gear 111 to turn the transmission gear 241 via the bevel gear 242, and therefore the grinding bit is turned.

Figure 6:
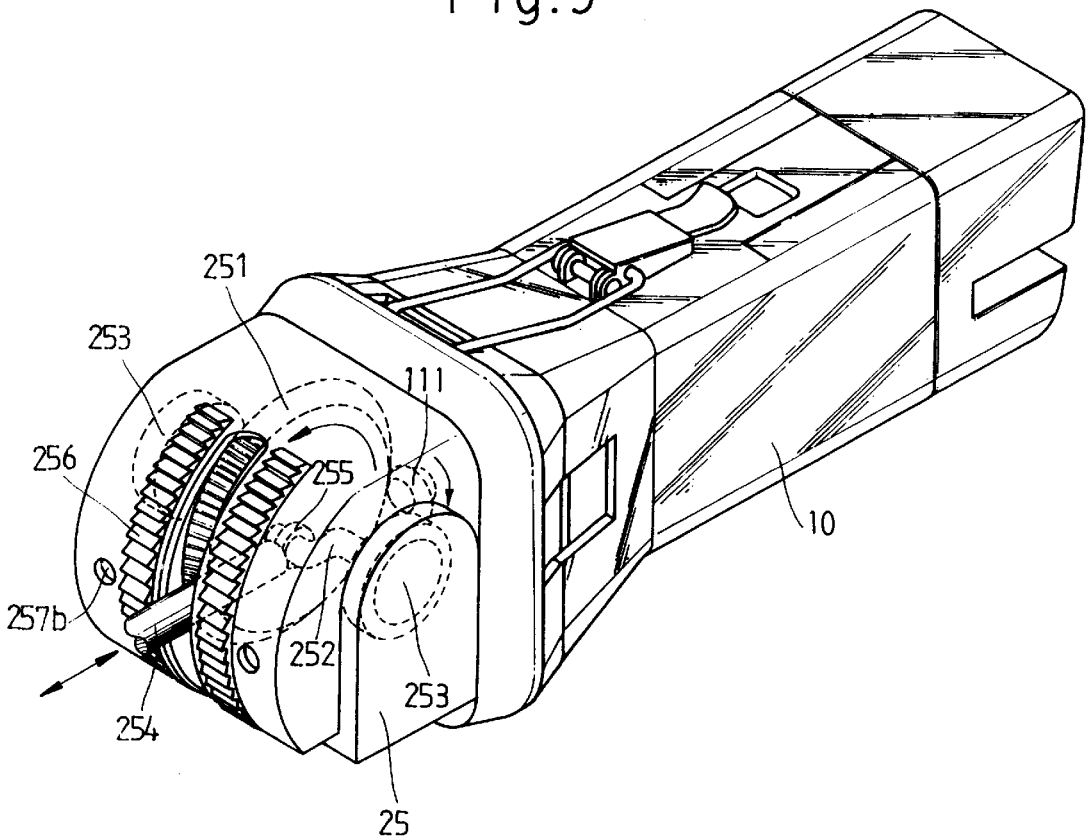
FIG. 6 is a perspective view of the present invention showing a second form of the grinding unit (the locating shell excluded)
Figure 7:
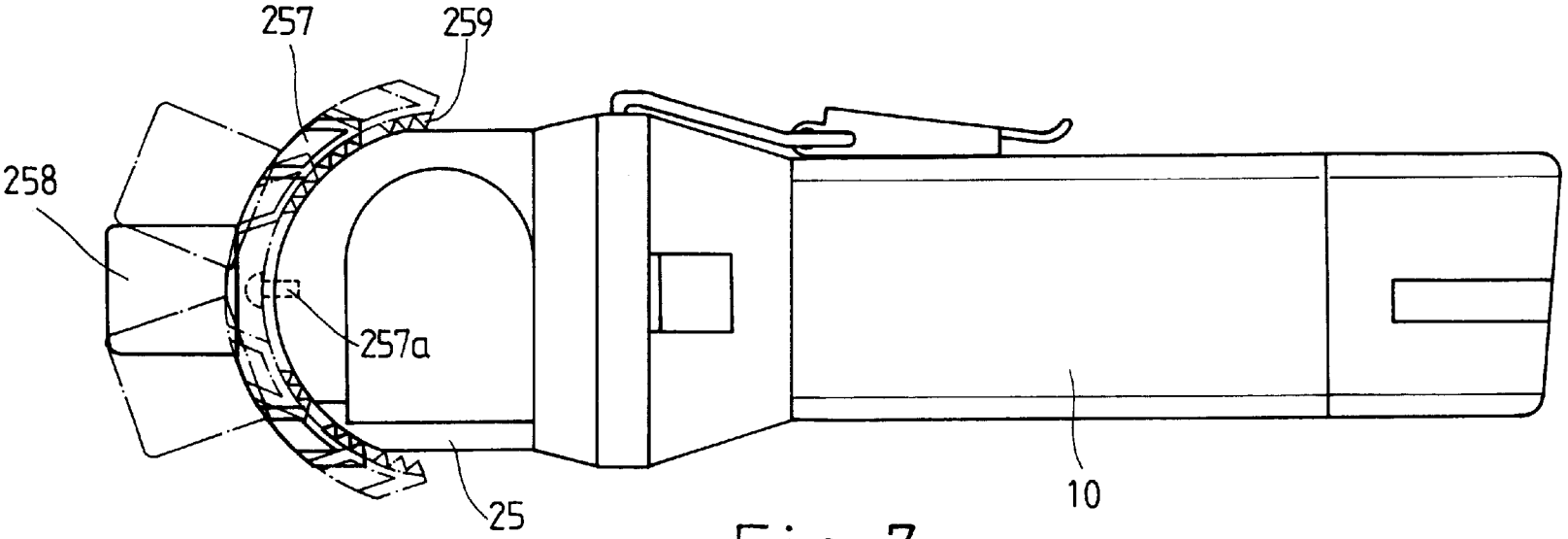
FIG. 7 is a side plain view of the present invention, showing the angular position of the locating shell of the second form of the grinding unit adjusted.
Figure 8:
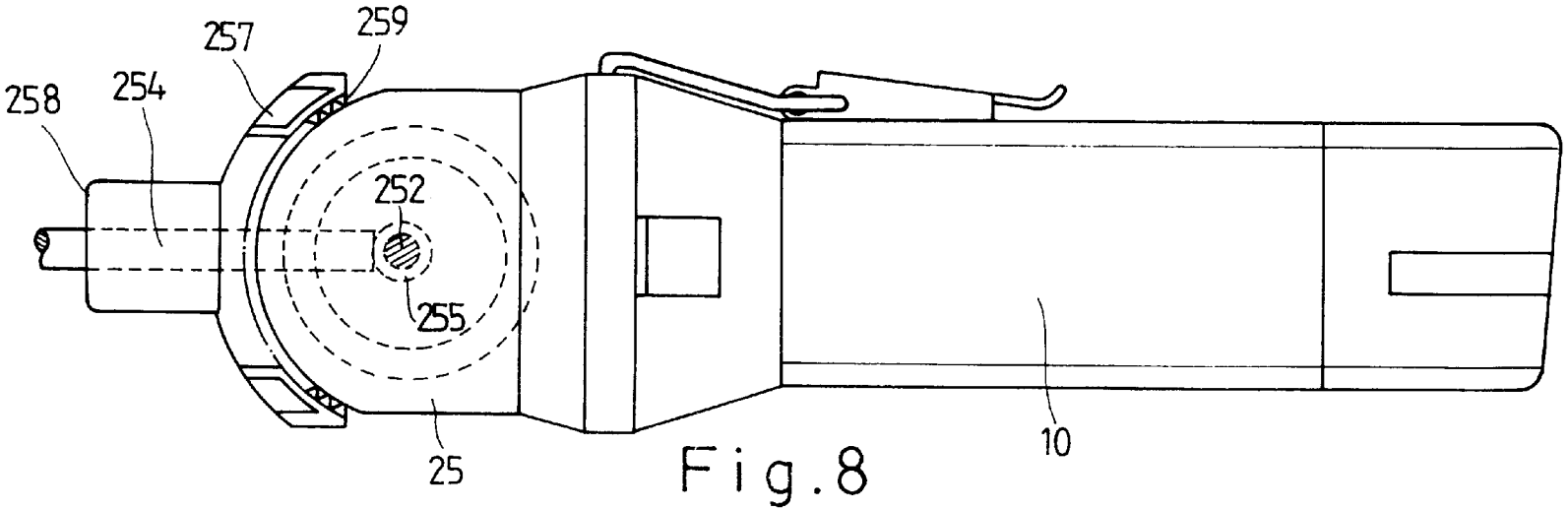
FIG. 8 is a top plain view of the second form of the grinding unit according to the present invention.

Referring to FIGS. 6, 7 and 8, the reciprocating grinding unit 25 comprises a transmission gear 251 meshed with the bevel gear 111 of the power drive unit 11 at right angles, two axle bearings 253 equally spaced from two opposite sides of the transmission gear 251, a link 252 eccentrically intersected with the bevel gear 111 and having both ends respectively supported on the axle bearings 253, two racks 256 bilaterally disposed between the axle bearings 253 and the transmission gear 251, two locating holes **257*b* bilaterally disposed at its front side, a locating shell 257 fastened to the locating holes 257*b* by for example screws 257*a* and having toothed portions 259 meshed with the rack 256 and a guide tube 258, and a reciprocating rod 254 having a rear eye end 255 coupled to the link 252 by a slip joint and a front end inserted through the guide tube 258 and coupled with a grinding bit (not shown) outside the guide tube 258. When the power drive unit 10 is operated, the transmission gear 251 is turned to reciprocate the reciprocating rod 254 via the link 252. Further, by changing the engagement position between the locating shell 257 and the racks 256, the angular position of the guide tube 258 (namely, the reciprocating direction of the reciprocating rod 254) is relatively changed (see FIG. 7). The locating shell 257 is preferably made having two rows of mounting holes adapted for adjustably fastening to the locating holes 257*b***.

Referring to FIG. 9, the surface grinding unit 26 comprises an opening 263 at one side, a transmission gear 261 disposed in the opening 263 and meshed with the bevel gear 111 of the power drive unit 10 at right angles, and a transmission shaft 262 perpendicularly raised from the center of the transmission gear 261 at an outer side and having an outer end 262*a* adapted for coupling to a grinding bit (not shown) for surface grinding.

It is to be understood that the drawings are designed for purposes of illustration only, and are not intended as a definition of the limits and scope of the invention disclosed.

What the invention claimed is:

1. A grinder comprising, a power drive unit having a driving shaft, wherein a bevel gear is fixedly mounted on one end of said driving shaft, and a grinding unit releasably connected to said power drive unit, said grinding unit comprising a grinding bit and a transmission mechanism coupled between said grinding bit and said bevel gear of said power drive unit when grinding unit and power drive unit are connected, wherein said grinding unit comprises a retaining hole and a coupling flange disposed on opposite sides thereof at different elevations with respect to one another said power drive unit comprises a coupling slot on a side thereof which receives said coupling flange of said grinding unit, when power drive unit and grinding unit are connected said power drive unit also comprising a pair of lugs raised from a periphery of said power drive, a lever pivoted to said lugs, and a hook pivoted to said lever and forced by said lever to hook in said retaining hole of said grinding unit when power drive unit and grinding unit are connected.

2. The grinder of claim 1, wherein said transmission mechanism of said grinding unit comprises a transmission shaft having a front end coupled to said grinding bit and a rear end fixedly mounted with a bevel gear, and a transmission gear meshed between the bevel gear of said transmission shaft and the bevel gear of said power drive unit.

3. The grinder of claim 1, wherein said transmission mechanism of said grinding unit comprises a transmission gear meshed with the bevel gear of said power drive unit at right angles, a link eccentrically intersected with said transmission gear and supported on axle bearings, a reciprocating rod having a rear end coupled to said link by a slip joint and a front end coupled to said grinding bit, said reciprocating rod being reciprocated by said link when said transmission gear is turned by the bevel gear of said power drive unit, and guide means adapted to guide the reciprocating motion of said reciprocating rod.

4. The grinder of claim 1, wherein said transmission mechanism of said grinding unit comprises an opening at one lateral side thereof, a transmission gear mounted in said opening and meshed with the bevel gear of said power drive unit at right angles, and a transmission shaft perpendicularly raised from the center of said transmission gear at an outer side and having an outer end coupled to said grinding bit.

* * * * *